US006526151B1

(12) United States Patent
Peng

(10) Patent No.: US 6,526,151 B1
(45) Date of Patent: Feb. 25, 2003

(54) HIGH STABILITY LOUDSPEAKER

(75) Inventor: Jack Peng, Taipei (TW)

(73) Assignee: Meiloon Industrial Co., Ltd., Taoyuan (TW)

( * ) Notice: Subject to any disclaimer, the term of this patent is extended or adjusted under 35 U.S.C. 154(b) by 216 days.

(21) Appl. No.: 09/605,839

(22) Filed: Jun. 29, 2000

(51) Int. Cl.[7] ..... H04R 25/00

(52) U.S. Cl. ..... 381/403; 381/397; 381/400; 381/404; 381/420; 181/171; 181/172

(58) Field of Search ..... 381/397, 398, 381/400, 407, 404, 412, 420, FOR 154, FOR 159, 403, 405; 181/171, 172, 199

(56) References Cited

U.S. PATENT DOCUMENTS 4,315,112 A * 2/1982 Hofer ..... 381/420
5,042,072 A * 8/1991 Button ..... 381/412
5,371,806 A * 12/1994 Kohara et al. ..... 381/420
6,095,280 A * 8/2000 Proni ..... 381/432
6,222,931 B1 * 4/2001 Cesati ..... 381/430

* cited by examiner

*Primary Examiner*—Curtis Kuntz
*Assistant Examiner*—Suhan Ni
(74) *Attorney, Agent, or Firm*—Bacon & Thomas

(57) ABSTRACT

A high stability loudspeaker has a yoke with a plurality of vents installed therein. The yoke is combined to a bottom of a frame of the loudspeaker. A magnet is placed in the yoke. A washer is arranged above the magnet. A periphery of the magnet is surrounded by a voice coil. A coil winding surrounds the voice coil. A combining portion is formed at a periphery of the yoke. The combining portion serves to be combined with a surround connected to a bottom of end of the voice coil. The voice coils is vertically installed in a gap between the portions of the yoke. The top of the voice coil is connected to another surround. Thereby, vibration of the voice coil is confined at the two ends. As a result, the gap between portions of the yoke structure into which the voice coil extends between portions of the yoke is reduced and therefore, the sensitivity of the loudspeaker is increased and the distortion is decreased.

6 Claims, 4 Drawing Sheets

HIGH STABILITY LOUDSPEAKER

FIELD OF THE INVENTION

The present invention relates to a high stability loudspeaker, which can effectively reduce the vibration of the voice coil in the lateral direction, and thus has a small distortion.

BACKGROUND OF THE INVENTION

As shown in FIG. 1, a prior art loudspeaker includes a frame A, a magnet B, a voice coil C, a damper D, a diaphragm E, a dust cover F, a yoke G, a washer H, a surround I and other components. The voice coil C surrounds the central post of the yoke G. Coils C1 wind around the voice coil C. Similarly, the damper D and diaphragm E cover the voice coil C by the central holes thereof. The top of the voice coil C is firmly secured with a dust cover F. The voice coil C and the diaphragm E are suspended between other components by the damper D and surround I. Thus, a loudspeaker is formed.

From the above, it will be appreciated that the voice coil C is connected to the diaphragm E, damper D and dust cover F by one end thereof. It suspends from the periphery of the central post of the yoke. When power is conducted, the coils C1 on the voice coil C are attracted and then vibrate so that the voice coil C moves upwards and downwards. Then the diaphragm E connected to the voice coil C transfers the vibration to air so as to form a sound capable of being heard by human's ears.

Since the material is not uniform, some errors occur. As the voice coil C is attracted, it will move laterally. Because the voice coil is suspended from the top end, the bottom of the voice coil C has a large vibration. Once the voice coil C collides with the washer H or the yoke G, noises occur. In order to prevent the voice coil C from colliding with the washer and yoke, the gap between the central post of the yoke G and the washer H must be enlarged. If the volume is increased, this gap J must be increased further. However, the larger the gap, the worse the sensitivity of the loudspeaker. Therefore, how to reduce the gap J between the yoke G and washer H is a primary problem in design of a loudspeaker.

SUMMARY OF THE INVENTION

Accordingly, the primary object of the present invention is to provide a high stability loudspeaker, in which the gap between the magnet and magnet groove is reduced.

Another object of the present invention is to provide a high stability loudspeaker with a reduced distortion.

In order to achieve the aforesaid objects, the present invention provides a high stability loudspeaker having a yoke with a plurality of vents installed therein. The yoke is combined to a bottom of a frame of the loudspeaker. A magnet is placed in the yoke and a washer is arranged above the magnet to form a yoke structure. A periphery of the magnet is surrounded by a voice coil. A coil winding surrounds the voice coil. A combining portion is formed at a periphery of the yoke. The combining portion serves to be combined with a surround connected to a bottom of the voice coil. The voice coil is vertically installed between the periphery of the yoke and the magnet. The top of the voice coil is connected to another surround. Thereby, the vibration of the voice coil is confined at the two ends. As a result, the gap between portions of the yoke structure into which the voice coil extends is reduced and therefore, the sensitivity of the loudspeaker is increased.

The various objects and advantages of the present invention will be more readily understood from the following detailed description when read in conjunction with the appended drawing.

DETAILED DESCRIPTION OF THE PREFERRED EMBODIMENTS

Figure 1:
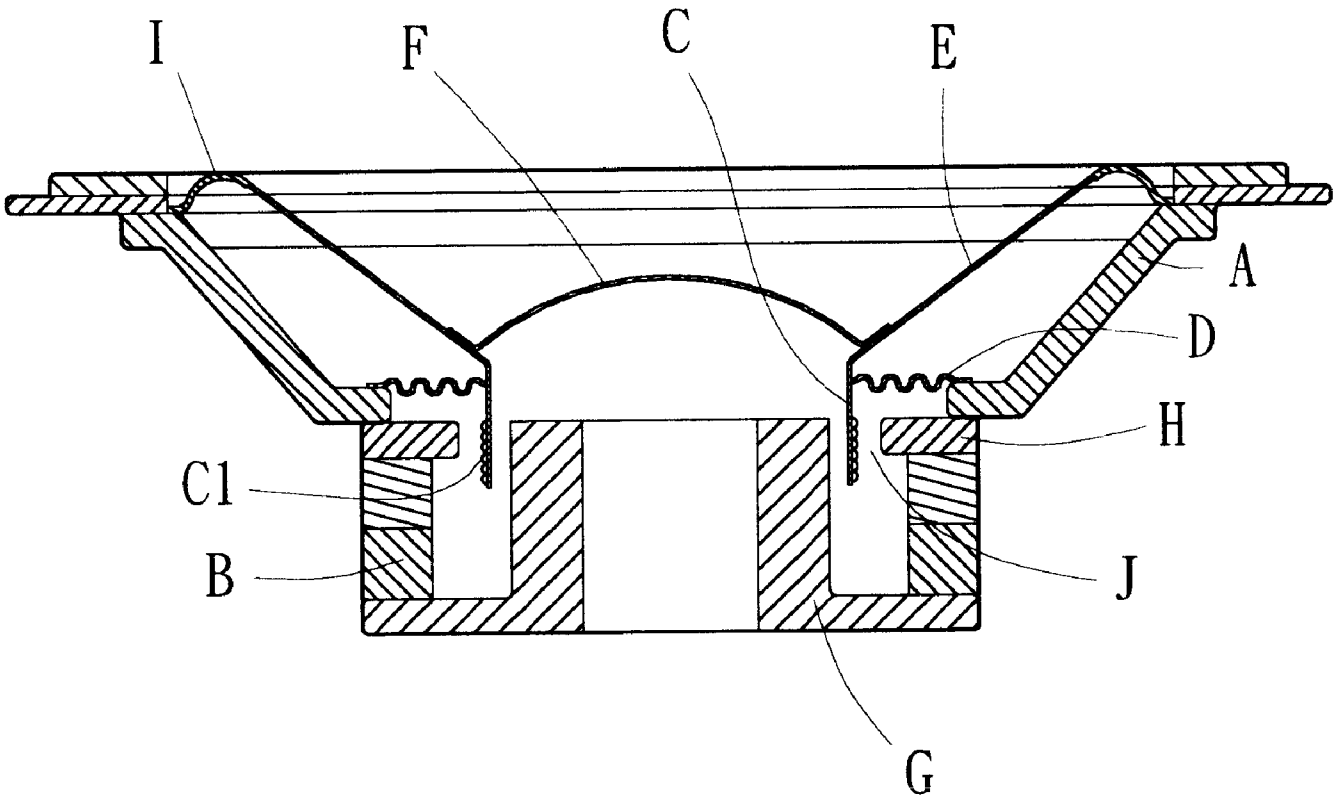
Fig. 1 (Prior Art)
FIG. 1 is a cross sectional view showing a prior art loudspeaker.
Figure 2:
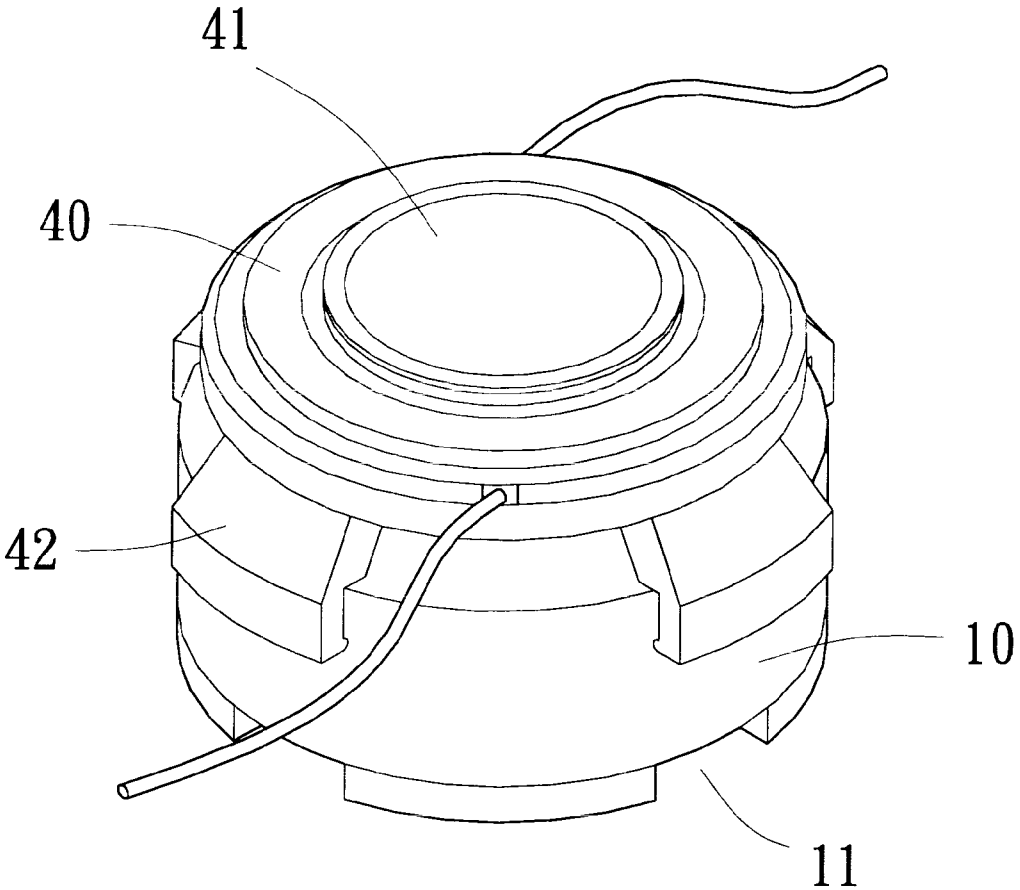
FIG. 2 is a perspective view showing one embodiment of the present invention.

FIG. 2 shows a perspective view of the high stability loudspeaker of the present invention, embodied by a small power loudspeaker. The high stability loudspeaker of the present invention mainly includes a yoke 10 with a small vent 11 at the bottom thereof. The top end of the yoke 10 is combined with a tooth shape frame 42. The frame 42 has a diaphragm 41 at the center thereof. The periphery of the diaphragm 41 is installed with a first surround 40 to be combined to the frame 42.

Figure 3:
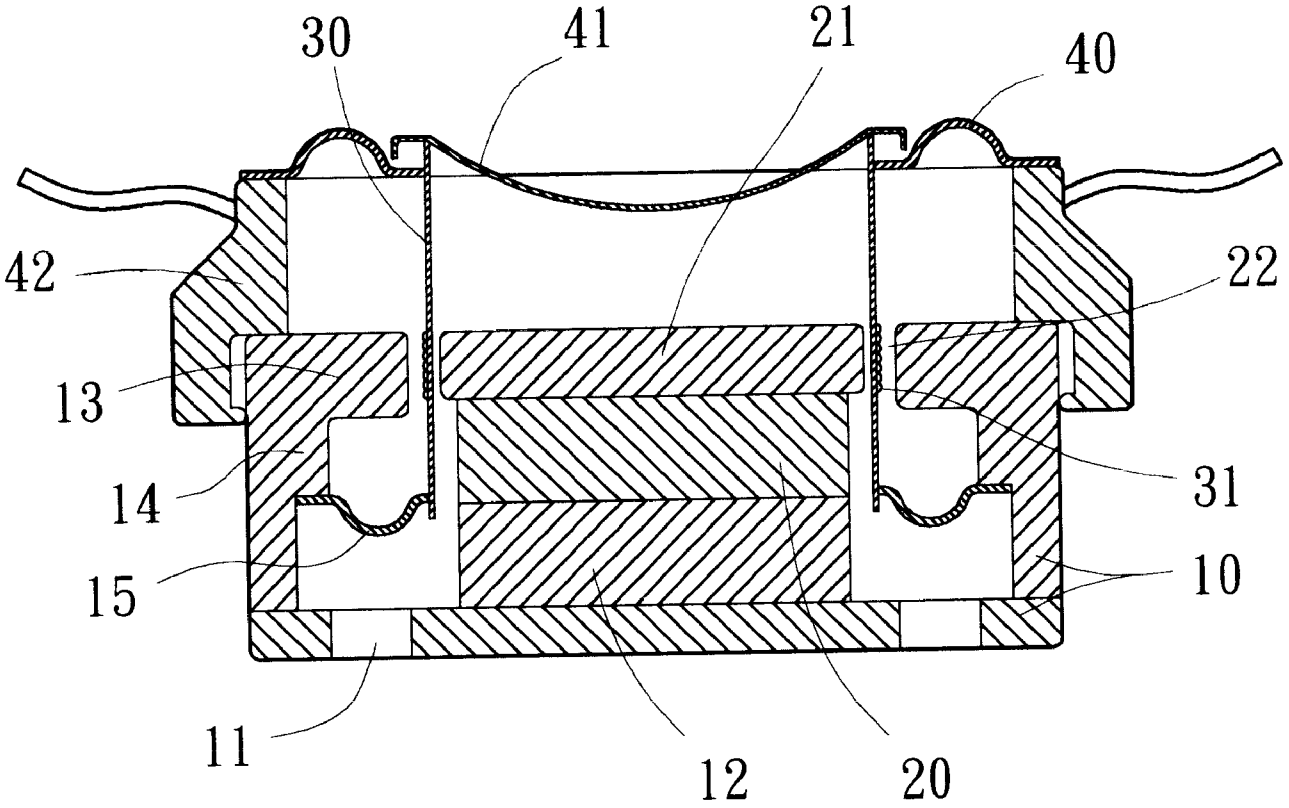
FIG. 3 is a cross sectional view showing the embodiment according to the present invention.

An inner cross sectional view of an embodiment according to the present invention is shown in FIG. 3. The periphery of the yoke 10 is formed with a combining portion 13. The combining portion 13 is a lip portion extending inwards through a predetermined length. The lower end of the lip is installed with a stepped portion 14. The stepped portion 14 is combined to a second surround 15. A short post 12 is installed at the center of the yoke 10. A magnet is formed on the short post 12. A washer 21 is disposed at the upper side of the magnet 20. A small gap 22 is formed between the washer 21 and the lip of the combining portion 13. A voice coil 13 curled from a thin piece is placed in the gap 22 so that the bottom of the voice coil 30 is combined with the surround 15. The top end thereof is further connected to the surround 40. A coil winding 31 surrounds the voice coil 30, which is exactly positioned in the small gap 22. The top of the voice coil 30 is combined to the diaphragm 41 so as to form, within yoke 10, a voice coil which has fulcrums at two ends.

Figure 4:
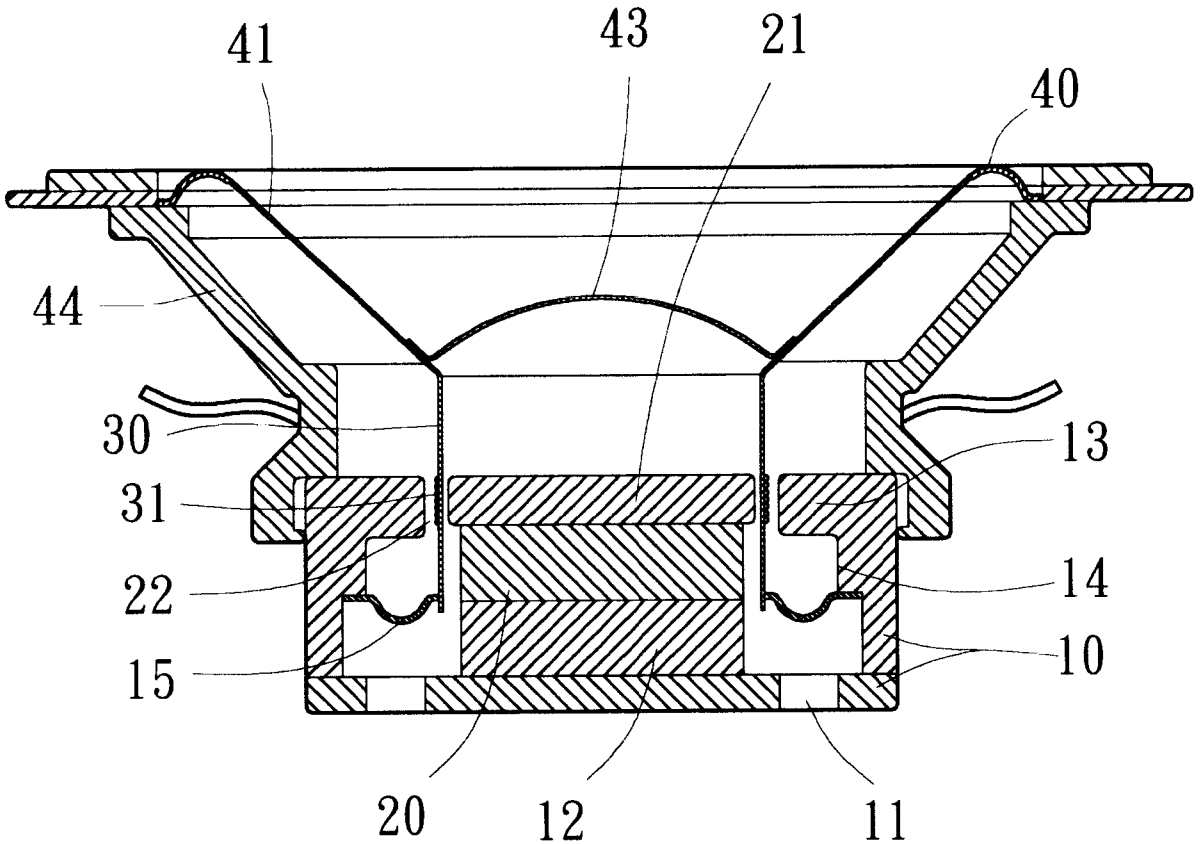
FIG. 4 is a cross sectional view showing another embodiment of the present invention.

FIG. 4 is a cross sectional view showing second embodiment of the present invention in the form of a large power loudspeaker. The top of the yoke 10 is combined to a frame 44 with a tapered expansion form (the interior of the frame is identical to that shown in FIG. 3, thus, the details will not be described herein). The surround 40 at the top edge of the frame 44 is connected to the diaphragm 41. The bottom of the diaphragm 41 is combined to a voice coil 30. The top of the voice coil 30 is combined to a dust cover 43. Similarly, two ends of the voice coils 30 have a fulcrum. When the loudspeaker conducts, the coil 31 is attracted by the magnetic field of the magnet so that the voice coil 30 begins to vibrate. The top and bottom of the voice coil 30 are confined by the surrounds 40 and 15. Therefore, the leftwards and rightwards vibration of the voice coil 31 has a very small possibility to be in contact with washer 21, which forms a portion of the yoke and is positioned on the magnet 20, and the lip of the combining portion 13. Therefore, the possibility of generating noise and distortion is also very small. As a consequence, the gap 22 between the washer 21 and the lip of the combining portion 13 is reduced greatly, and therefore, the sensitivity of the loudspeaker is effectively improved.

As a result, according to aforesaid description, the present invention can achieve the predetermined object. In the present invention, the voice coil has two supporting fulcrums and thus, the vibration of the voice coil is reduced greatly. Consequently, the gap between the washer and the yoke is decreased. The sensitivity of the loudspeaker is improved effectively and meanwhile the distortion of the loudspeaker is also reduced.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A high stability loudspeaker having a yoke structure with a plurality of vents installed therein, the yoke structure being combined with a bottom of a frame of the loudspeaker; a short post being installed in a center of the yoke structure; a magnet being formed on the short post, wherein a periphery of the magnet is surrounded by a voice coil having a first end and a second end, said voice coil extending into a gap between portions of said yoke structure;

a coil winding surrounds the voice coil;

the first end of the voice coil is connected to a diaphragm and to a first surround, said first surround being connected to said frame; and the second end of the voice coil is connected to a second surround, said second surround being connected to a combining portion formed at a periphery of said yoke structure.

2. The high stability loudspeaker as claimed in claim 1, wherein the combining portion at the periphery of the yoke structure is a lip extending inwards by a predetermined distance.

3. The high stability loudspeaker as claimed in claim 1, wherein a lower edge of a lip of the combining portion in the yoke structure is installed with a stepped portion connected with the second surround.

4. A high stability loudspeaker having a yoke structure with a plurality of vents installed therein, the yoke structure being combined with a bottom of a frame of the loudspeaker; a short post being installed in a center of the yoke structure; a magnet being formed on the short post, wherein a periphery of the magnet is surrounded by a voice coil having a first end and a second end, said voice coil extending into a gap between portions of said yoke structure;

a coil winding surrounds the voice coil;

the first end of the voice coil is connected to a diaphragm and said diaphragm is connected to a first surround, said first surround being connected to said frame; and the second end of the voice coil is connected to a second surround, said second surround being connected to a combining portion formed at a periphery of said yoke structure.

5. The high stability loudspeaker as claimed in claim 4, wherein the combining portion at the periphery of the yoke structure is a lip extending inwards by a predetermined distance.

6. The high stability loudspeaker as claimed in claim 4, wherein a lower edge of a lip of the combining portion in the yoke structure is installed with a stepped portion connected with the second surround.

* * * * *